US008601687B2

(12) United States Patent
Ochoa et al.

(10) Patent No.: US 8,601,687 B2
(45) Date of Patent: Dec. 10, 2013

(54) PUMP BODY

(75) Inventors: Brian Ochoa, Hanover (DE); Philippe Gambier, La Defense (FR); Aude Faugere, Houston, TX (US); Christopher Shen, Houston, TX (US); Joe Hubenschmidt, Sugar Land, TX (US); Tze Wei Chua, Stafford, TX (US); Walter Taylor, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 311 days.

(21) Appl. No.: 12/840,545

(22) Filed: Jul. 21, 2010

(65) Prior Publication Data

US 2011/0081268 A1 Apr. 7, 2011

(51) Int. Cl.
*B23P 15/10* (2006.01)

(52) U.S. Cl.
USPC ..... 29/888.042; 417/360; 248/639

(58) Field of Classification Search
USPC ..... 417/360, 521, 571; 137/512; 248/639; 29/888.02, 888.042, 888.044
See application file for complete search history.

(56) References Cited

U.S. PATENT DOCUMENTS

| | | | | |
|---|---|---|---|---|
| 4,388,050 | A | 6/1983 | Schuller | |
| 5,024,116 | A | 6/1991 | Kraft | |
| 6,382,940 | B1 | 5/2002 | Blume | |
| 6,419,459 | B1 | 7/2002 | Sibbing | |
| 6,910,871 | B1 * | 6/2005 | Blume | 417/571 |
| 7,186,097 | B1 | 3/2007 | Blume | |
| 7,354,256 | B1 | 4/2008 | Cummins | |
| 7,484,452 | B2 | 2/2009 | Baxter et al. | |
| 7,513,759 | B1 | 4/2009 | Blume | |
| 2003/0235508 | A1 | 12/2003 | Vicars | |
| 2008/0000065 | A1 * | 1/2008 | Ganguly et al. | 29/421.1 |
| 2008/0138224 | A1 | 6/2008 | Vicars | |
| 2009/0081034 | A1 | 3/2009 | Gambier et al. | |
| 2009/0092510 | A1 | 4/2009 | Williams et al. | |

FOREIGN PATENT DOCUMENTS

WO 2011027273 A2 3/2011

OTHER PUBLICATIONS

Cementing HT-400 Pump, Halliburton Brochure, H04798, Apr. 2006.
MSI X-treme Service Brochure.

* cited by examiner

*Primary Examiner* — Charles Freay
*Assistant Examiner* — Patrick Hamo
(74) *Attorney, Agent, or Firm* — Myron K. Stout; Daryl Wright; Tim Curington

(57) ABSTRACT

A multiplex fluid pump assembled from a plurality of pump bodies connected side by side between opposing end plates with a plurality of fasteners tightened to compress the pump bodies between the end plates. Raised surfaces on opposite exterior side surfaces of each pump body are engaged with an adjacent end plate or an adjacent pump body to apply a pre-compressive force at the raised surfaces and thereby inhibit the initiation of fatigue cracks.

20 Claims, 5 Drawing Sheets

PUMP BODY

CROSS REFERENCE TO RELATED APPLICATION(S)

This application claims the benefit of and priority to provisional application U.S. 61/233,709, filed Aug. 13, 2009.

STATEMENT REGARDING FEDERALLY SPONSORED RESEARCH OR DEVELOPMENT

Not applicable

THE NAMES OF PARTIES TO A JOINT RESEARCH AGREEMENT

Not applicable

INCORPORATION BY REFERENCE OF MATERIAL SUBMITTED ON A COMPACT DISC

Not applicable

BACKGROUND OF THE INVENTION (1) Field of the Invention

The current application is related in general to wellsite surface equipment such as fracturing pumps and the like.

(2) Description of Related Art including information disclosed under 37 CFR 1.97 and 1.98

Reciprocating pumps such as triplex pumps and quintuplex pumps are generally used to pump high pressure fracturing fluids downhole. Typically, the pumps that are used for this purpose have plunger sizes varying from about 7 cm (2.75 in.) to about 16.5 cm (6.5 in.) in diameter and may operate at pressures up to 144.8 MPa (21,000 psi). In one case, the outer diameter of the plunger is about 9.5 cm (3.75 in) and the reciprocating pump is a triplex pump.

These pumps typically have two sections: (a) a power end, the motor assembly that drives the pump plungers (the driveline and transmission are parts of the power end); and (b) a fluid end, the pump container that holds and discharges pressurized fluid.

In triplex pumps, the fluid end has three fluid cylinders. For the purpose of this document, the middle of these three cylinders is referred to as the central cylinder, and the remaining two cylinders are referred to as side cylinders. A fluid end may comprise a single block having cylinders bored therein, known in the art as a monoblock fluid end. Similarly, a quintuplex pump has five fluid cylinders, including a middle cylinder and four side cylinders.

The pumping cycle of the fluid end is composed of two stages: (a) a suction cycle: During this part of the cycle a piston moves outward in a packing bore, thereby lowering the fluid pressure in the fluid end. As the fluid pressure becomes lower than the pressure of the fluid in a suction pipe (typically 2-3 times the atmospheric pressure, approximately 0.28 MPa (40 psi)), the suction valve opens and the fluid end is filled with pumping fluid; and (b) a discharge cycle: During this cycle, the plunger moves forward in the packing bore, thereby progressively increasing the fluid pressure in the pump and closing the suction valve. At a fluid pressure slightly higher than the line pressure (which can range from as low as 13.8 MPa (2,000 psi) to as high as 144.8 MPa (21,000 psi) the discharge valve opens, and the high pressure fluid flows through the discharge pipe. In some cases, the pump is operated at 12,000 psi. In some other cases, the pump is operated at 15,000 psi. In some further cases, the pump is operated at 20,000 psi.

Most commercially available reciprocating pumps for fracturing jobs are rated at least 300 RPM, or 5 Hz. Given a pumping frequency of 2 Hz, i.e., 2 pressure cycles per second, the fluid end body can experience a very large number of stress cycles within a relatively short operational lifespan. These stress cycles may induce fatigue failure of the fluid end. Fatigue involves a failure process where small cracks initiate at the free surface of a component under cyclic stress. The cracks may grow at a rate defined by the cyclic stress and the material properties until they are large enough to warrant failure of the component. Since fatigue cracks generally initiate at the surface, a strategy to counter such failure mechanism is to pre-load the surface under compression.

Typically, this is done through an autofrettage process, which involves a mechanical pre-treatment of the fluid end in order to induce residual compressive stresses at the internal free surfaces, i.e., the surfaces that are exposed to the fracturing fluid, also known as the fluid end cylinders. US 2008/000065 is an example of an autofrettage process for pretreating the fluid end cylinders of a multiplex pump. During autofrettage, the fluid end cylinders are exposed to high hydrostatic pressures. The pressure during autofrettage causes plastic yielding of the inner surfaces of the cylinder walls. Since the stress level decays across the wall thickness, the deformation of the outer surfaces of the walls is still elastic. When the hydrostatic pressure is removed, the outer surfaces of the walls tend to revert to their original configuration. However, the plastically deformed inner surfaces of the same walls constrain this deformation. As a result, the inner surfaces of the walls of the cylinders inherit a residual compressive stress. The effectiveness of the autofrettage process depends on the extent of the residual stress on the inner walls and their magnitude.

It remains desirable to provide improvements in wellsite surface equipment in efficiency, flexibility, reliability, and maintainability.

BRIEF SUMMARY OF THE INVENTION

The present application in one embodiment applies pre-compressive forces to raised surfaces on pump bodies to inhibit initiation of fatigue cracks in the fluid end of a multiplex pump.

In one embodiment, a method comprises connecting a plurality of pump bodies side by side between opposing end plates with a plurality of fasteners to form a pump assembly. Each pump body comprises a piston bore, an inlet bore, an outlet bore and at least one pump body comprises a raised surface on an opposite exterior side surface thereof. The raised surface engages with an adjacent end plate or an adjacent pump body. In another embodiment, each pump body comprises a raised surface on an opposite exterior side surface thereof. The method also comprises tightening the fasteners to compress the pump bodies between the end plates. In this manner, a pre-compressive force can be applied at the raised surfaces on each of the pump bodies.

In one embodiment, a fluid pump assembly comprises a plurality of pump bodies connected side by side between opposing end plates with a plurality of fasteners tightened to compress the pump bodies between the end plates. Each pump body comprises a piston bore, an inlet bore, an outlet bore and raised surfaces on opposite exterior side surfaces thereof. The raised surfaces engage with an adjacent end plate or an adjacent pump body to apply a pre-compressive force at the raised surfaces on each of the pump bodies.

In one embodiment, a method is provided to inhibit fatigue cracks in a fluid pump assembly comprising a plurality of pump bodies comprising a piston bore, an inlet bore and an outlet bore. This method in an embodiment comprises: (a) providing raised surfaces on opposite exterior side surfaces of the plurality of pump bodies; (b) forming the pump assembly by connecting the plurality of pump bodies side by side between opposing end plates with a plurality of fasteners, wherein the raised surfaces engage with an adjacent end plate or an adjacent pump body; and (c) tightening the fasteners to compress the plurality of pump bodies between the end plates, whereby a pre-compressive force is applied at the raised surfaces on each of the pump bodies.

In the various embodiments, the pump bodies can also be optionally autofrettaged.

In the various embodiments, the fasteners can be or include tie rods extending through bores aligned through the pump bodies.

In the various embodiments, the raised surfaces can engage with an adjacent end plate or the raised surface of an adjacent pump body.

In the various embodiments, the pre-compressive force can be applied at a predetermined location of each of the pump bodies.

In the various embodiments, the raised surfaces can be adjacent an intersection of the piston bore, the inlet bore, and the outlet bore.

In the various embodiments, the pre-compressive force can extend the operational life of the assembly by reducing stress adjacent an intersection of the piston bore, the inlet bore, and the outlet bore.

In the various embodiments, the pump assembly can be operated to reciprocate a piston in the piston bore and cycle between relatively high and low fluid pressures in the inlet and outlet bores, wherein the compression of the pump bodies between the end plates inhibits, delays, or postpones the initiation of fatigue cracks.

In the various method embodiments, the method can further comprise disassembling the fluid pump assembly to remove one of the pump bodies exhibiting fatigue crack initiation, and reassembling the fluid pump assembly with a replacement pump body without fatigue cracks.

DETAILED DESCRIPTION OF THE INVENTION

Figure 6:
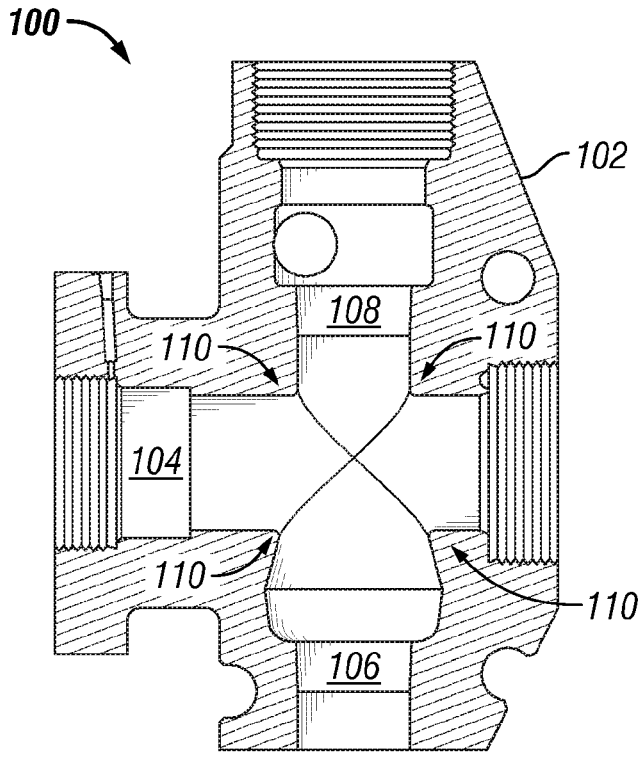
FIG. 6 is a side sectional view of the pump body of FIG. 5 according to an embodiment of the application.
Figure 7:
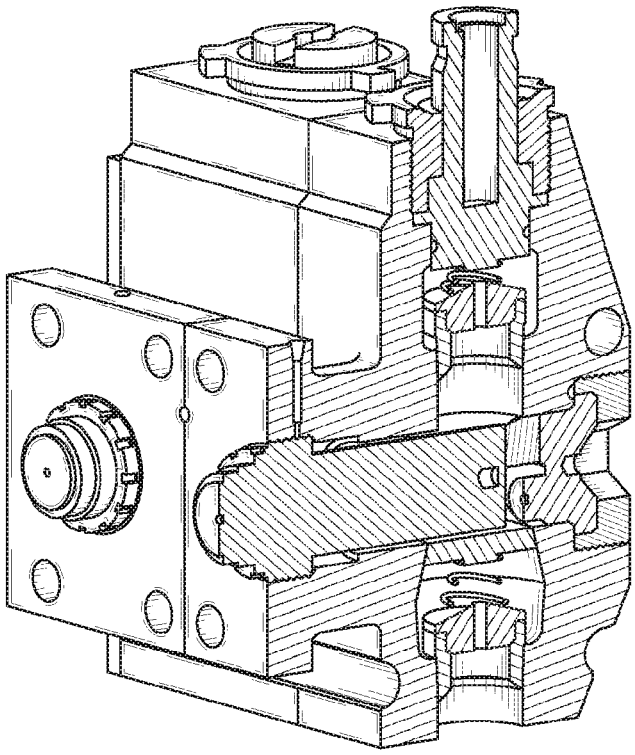
FIG. 7 is a perspective view, partially cut away, of the pump fluid end assembly of FIGS. 1-4 according to an embodiment of the application.
Figure 8:
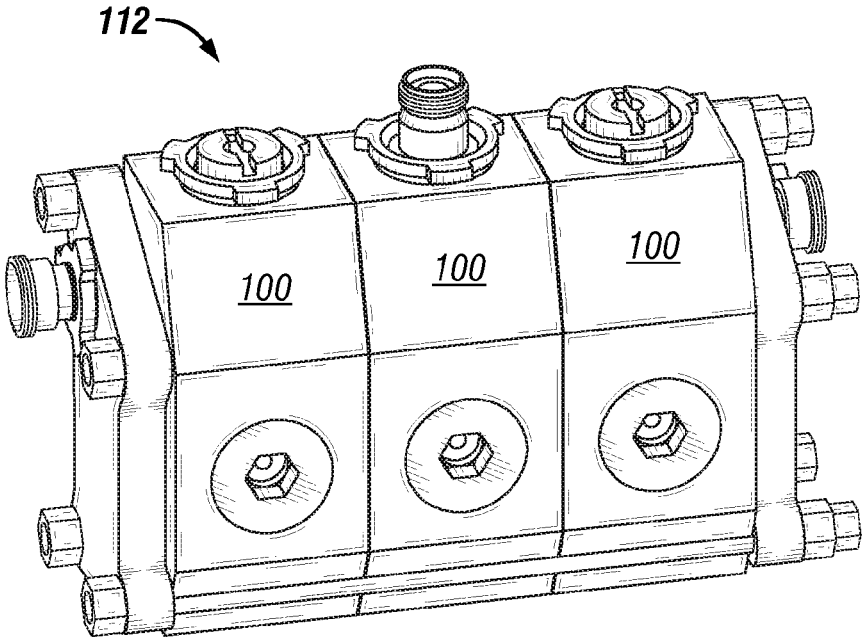
FIG. 8 is another fluid end perspective view of the triplex pump fluid end assembly of FIGS. 1-3 according to an embodiment of the application.
Figure 9:
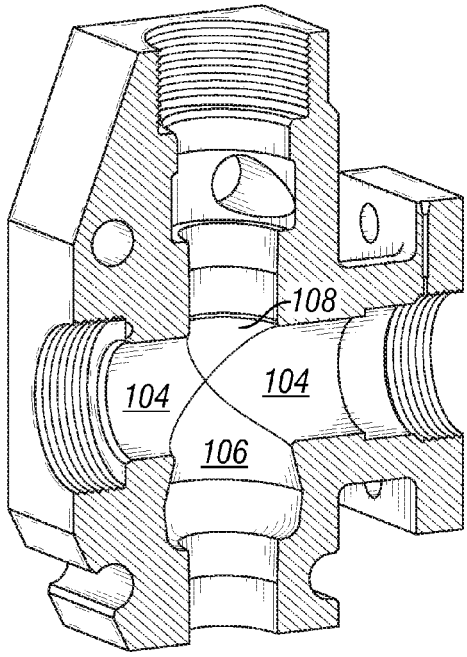
FIG. 9 is a perspective view of the bore configuration of the pump body of FIGS. 5-6 according to an embodiment of the application.

Referring now to all of the Figures, there is disclosed a pump body portion or fluid end, indicated generally at 100. The pump body portion 100 comprises a body 102 that defines an internal passage or piston bore 104 for a receiving a pump plunger (best seen in FIG. 7). The pump body portion 100 may further define an inlet port 106 and an outlet port 108. The inlet port 106 and the outlet port 108 may be substantially perpendicular to the piston bore 104, forming a conventional crossbore body portion 100, best seen in FIG. 6. The piston bore 104 may comprise a pair of bores, such as that shown in FIG. 9. The intersection of the piston bore 104 and the inlet and outlet ports 106 and 108 defines at least one area 110 of stress concentration that may be a concern for material fatigue failure. In addition to the stress concentration, the area 110 is subject to operational pressure of the pump discussed hereinabove, which may further increase its fatigue failure risk. Those skilled in the art will appreciate that the pump body portion 100 may comprise bores formed in other configurations such as a T-shape, Y-shape, in-line, or other configurations.

Figure 1:
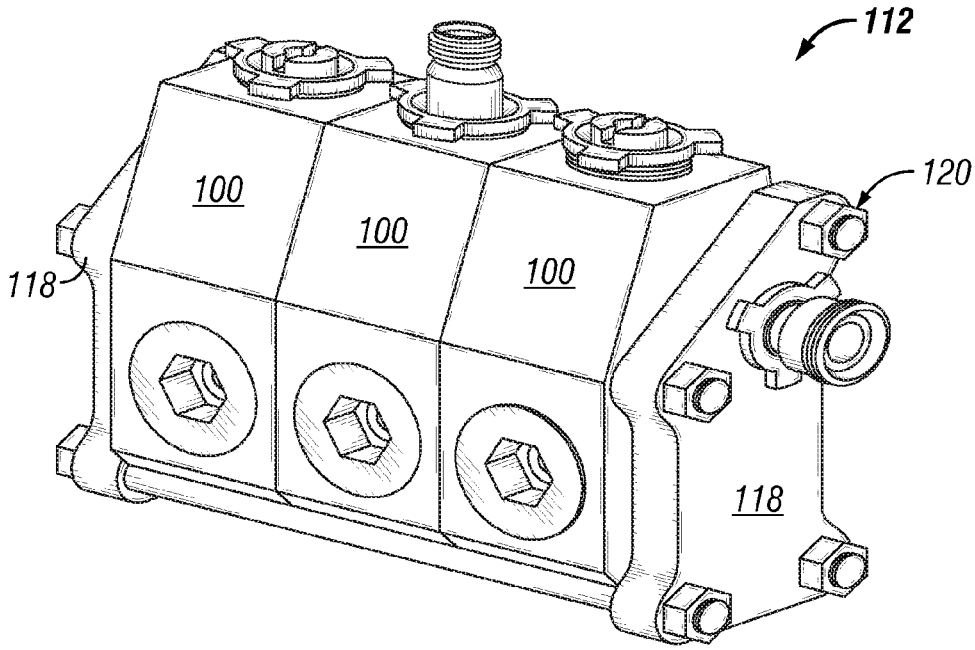
FIG. 1 is a fluid end perspective view of a triplex pump fluid end assembly according to an embodiment of the application.
Figure 2:
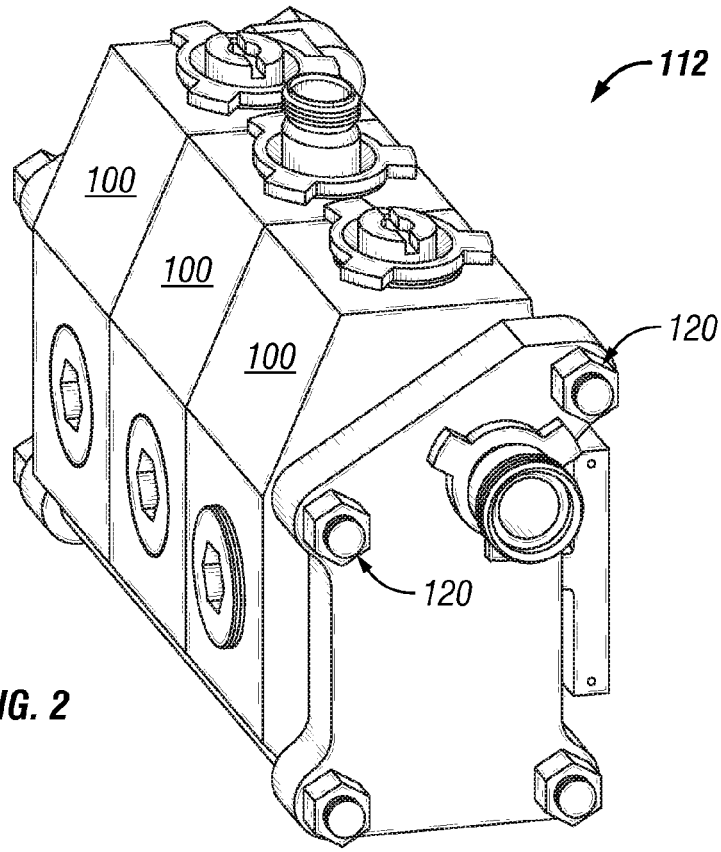
FIG. 2 is another fluid end perspective view of the triplex pump fluid end assembly of FIG. 1 according to an embodiment of the application.

According to some embodiments, three pump body portions 100 are arranged to form a triplex pump assembly 112, best seen in FIG. 1. Those skilled in the art will appreciate that the pump body portions 100 may also be arranged in other configurations, such as a quintuplex pump assembly comprising five pump body portions 100 or the like.

Figure 5:
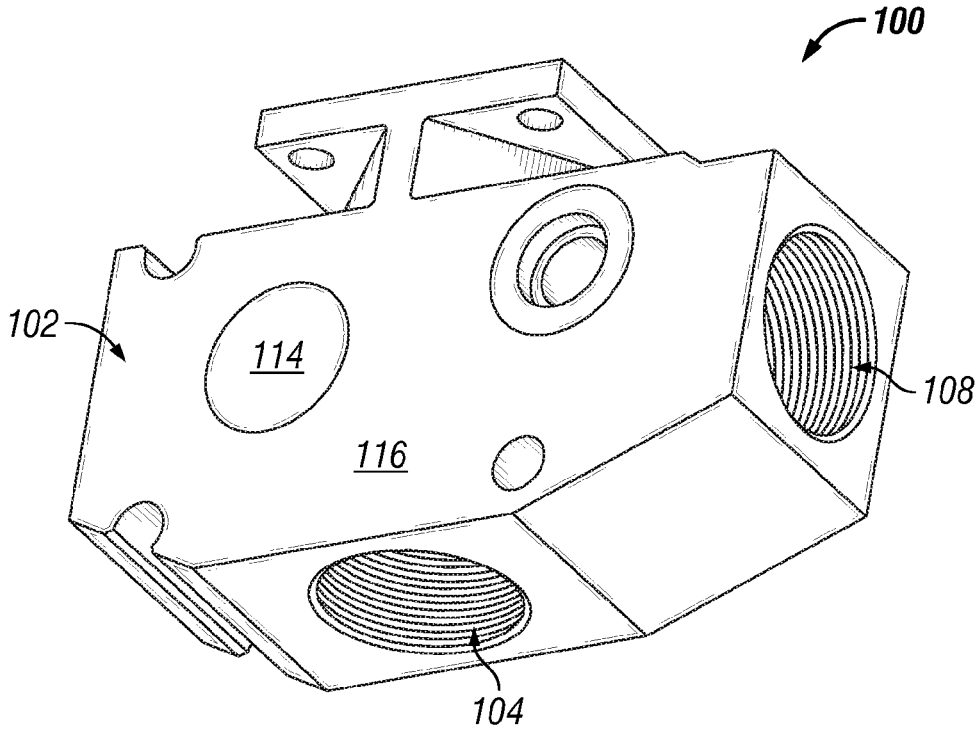
FIG. 5 is a perspective view of one of the pump body portions of the triplex pump fluid end assembly of FIGS. 1-4 according to an embodiment of the application.

A raised surface 114 extends from an exterior surface 116 of the pump body portions 100, best seen in FIG. 5. The raised surface 114 may extend a predetermined distance from the exterior surface 116 and may define a predetermined area on the exterior surface 116. In one embodiment, at least one pump body comprises a raised surface on an opposite exterior side surface of the pump body. In another embodiment, each pump body comprises a raised surface on the opposite exterior side surface of the pump body. While illustrated as circular in shape in FIG. 5, the raised surface 114 may be formed in any suitable shape.

Figure 10:
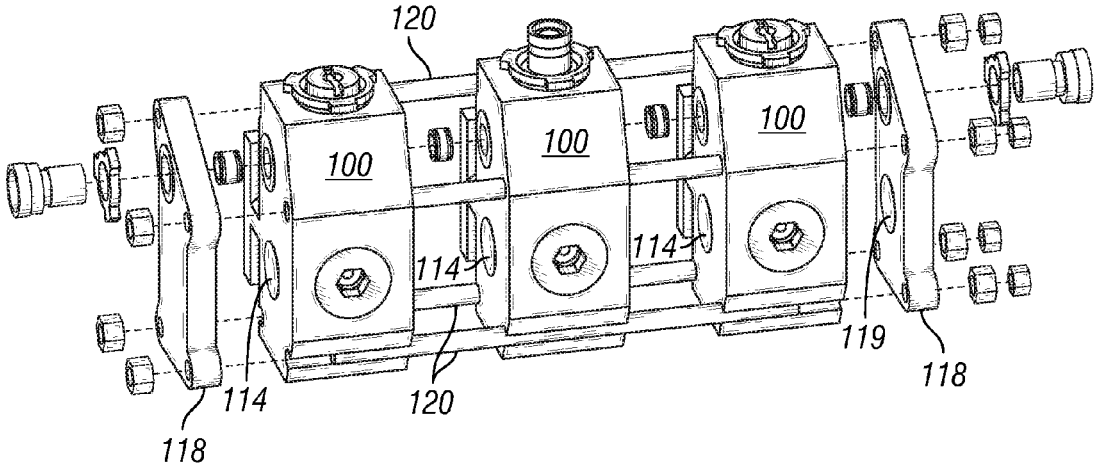
FIG. 10 is an exploded view of the triplex pump fluid end assembly of FIGS. 1-3 according to an embodiment of the application.

An end plate 118 is fitted on each of the outer or side pump body portions 100 to aid in assembling the body portions 100 into the pump fluid end assembly, such as the triplex pump fluid end assembly 112 shown in FIG. 1. The end plates 118 are utilized, in conjunction with fasteners 120, to assemble the pump body portions 100 to form the pump fluid end assembly 112. The end plates 118 may further comprise a raised surface 119, best seen in FIG. 10, similar to the surface 114 on the pump body portions 100 for engaging with the raised surfaces 114 of the pump body portions 100 during assembly.

The bores 104, 106, and 108 of the pump body portions 100 may define substantially similar internal geometry as prior art monoblock fluid ends to provide similar volumetric performance. When the pump fluid end assembly 112 is assembled, the three pump body portions 100 are assembled together using, for example, four large fasteners or tie rods 120 and the end plates 118 on opposing ends of the pump body portions 100. At least one of the tie rods 120 may extend through the pump body portions 100, while the other of the tie rods 120 may be external of the pump body portions 100.

As the tie rods 120 are torqued (via nuts or the like) to assemble the pump fluid end assembly 112, the raised surfaces 114 on the pump body portions 100 and raised surfaces 119 on the end plates 118 engage with one another to provide a pre-compressive force to the areas 110 of the pump body portions 100 adjacent the intersection of the bores 104, 106, and 108. The pre-compressive force is believed to counteract the potential deformation of the areas 110 due to the operational pressure encountered by the bores 104, 106, and 108. By counteracting the potential deformation due to operational pressure, stress on the areas 110 of the pump body portions 100 is reduced, thereby increasing the overall life of the pump bodies 100 by reducing the likelihood of fatigue failures. Those skilled in the art will appreciate that the torque of the fasteners 120 and the raised surfaces 114 and 119 cooperate to provide the pre-compressive force on the areas 110.

Due to the substantially identical profiles of the plurality of pump body portions 100, the pump body portions 100 may be advantageously interchanged between the middle and side portions 100 of the assembly 112, providing advantages in assembly, disassembly, and maintenance, as will be appreciated by those skilled in the art. In operation, if one of the pump bodies 100 of the assembly 112 fails, only the failed one of the pump bodies 100 need be replaced, reducing the potential overall downtime of a pump assembly 112 and its associated monetary impact. The pump body portions 100 are smaller than a typical monoblock fluid end having a single body with a plurality of cylinder bores machined therein and therefore provides greater ease of manufacturability due to the reduced size of forging, castings, etc.

Figure 3:
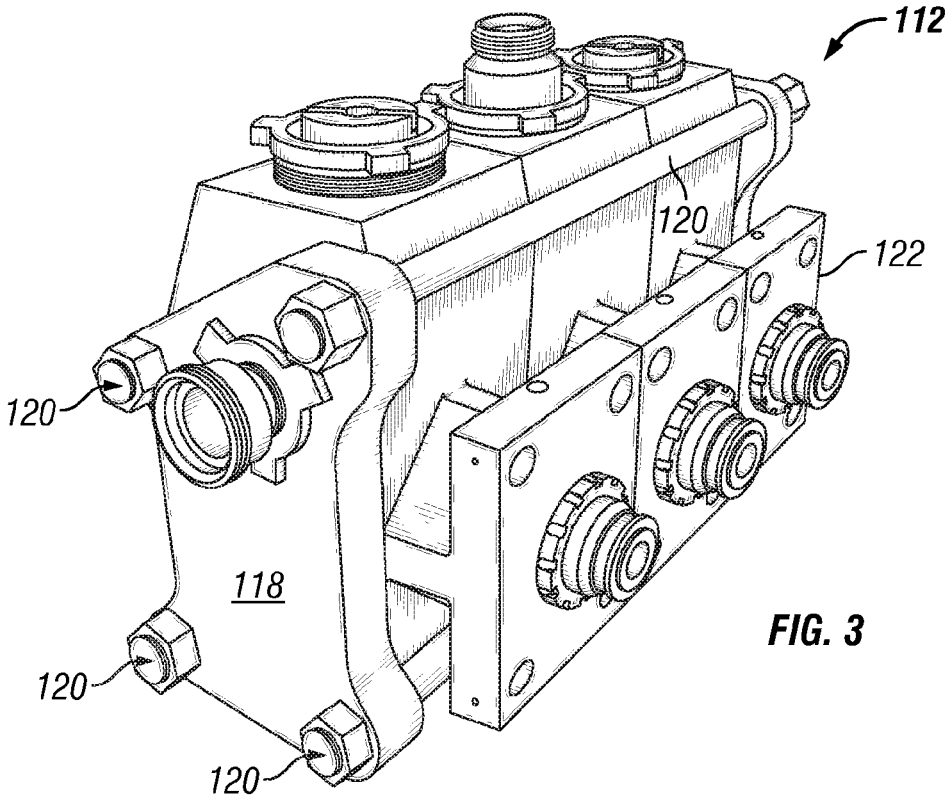
FIG. 3 is a power end perspective view of the triplex pump fluid end assembly of FIGS. 1-2 according to an embodiment of the application.
Figure 4:
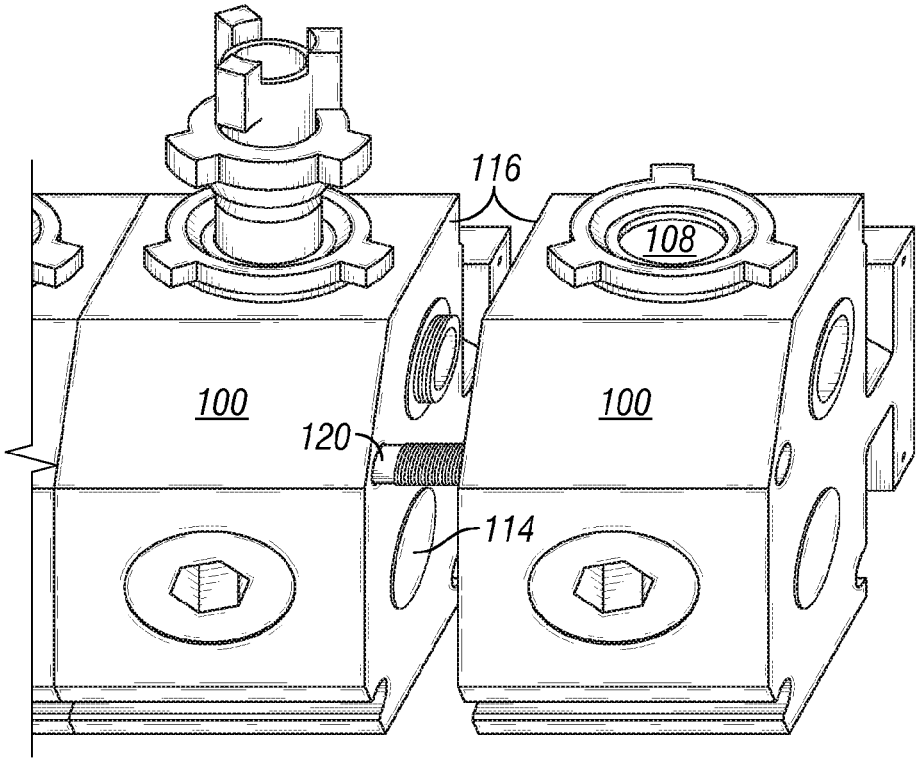
FIG. 4 is a partially disassembled view of the triplex pump fluid end assembly of FIGS. 1-3 according to an embodiment of the application.

An attachment flange 122, best seen in FIG. 3, may extend from the pump body portion 100 for guiding and attaching a power end (not shown) to the plungers (see FIG. 7) and ultimately to a prime mover (not shown), such as a diesel engine or the like, as will be appreciated by those skilled in the art.

The preceding description has been presented with reference to present embodiments. Persons skilled in the art and technology to which this disclosure pertains will appreciate that alterations and changes in the described structures and methods of operation can be practiced without meaningfully departing from the principle, and scope of this application. Accordingly, the foregoing description should not be read as pertaining only to the precise structures described and shown in the accompanying drawings, but rather should be read as consistent with and as support for the following claims, which are to have their fullest and fairest scope.

We claim:

1. A method, comprising:

connecting a plurality of pump bodies side by side between opposing end plates with a plurality of fasteners to form a pump assembly, wherein each pump body comprises a piston bore, an inlet bore, and an outlet bore and at least one pump body comprises a raised surface on an exterior side surface thereof, wherein the raised surface engages with an adjacent end plate or an adjacent pump body; and tightening the fasteners to compress the pump bodies between the end plates, whereby a pre-compressive force is applied at the raised surface on the at least one pump body.

2. The method of claim 1, further comprising autofrettaging the pump bodies.

3. The method of claim 1, wherein each pump body comprises a raised surface on an exterior side surface thereof.

4. The method of claim 1, wherein the adjacent end plate comprises a raised surface, and the raised surface of the at least one pump body engages the raised surface of the adjacent end plate.

5. The method of claim 1, wherein the raised surface of a pump body engages with the raised surface of an adjacent pump body.

6. The method of claim 3, wherein the raised surface is adjacent an intersection of the piston bore, the inlet bore, and the outlet bore.

7. The method of claim 1, wherein the pre-compressive force extends the operational life of the assembly by reducing stress adjacent an intersection of the piston bore, the inlet bore, and the outlet bore.

8. The method of claim 1, further comprising operating the pump assembly to reciprocate a piston in the piston bore and cycle between relatively high and low fluid pressures in the inlet and outlet bores, wherein the compression of the pump bodies between the end plates inhibits initiation of fatigue cracks.

9. The method of claim 8, further comprising disassembling the fluid pump assembly to remove one of the pump bodies exhibiting fatigue crack initiation, and reassembling the fluid pump assembly with a replacement pump body without fatigue cracks.

10. A fluid pump assembly, comprising:

a plurality of pump bodies connected side by side between opposing end plates with a plurality of fasteners tightened to compress the pump bodies between the end plates;

wherein each pump body comprises a piston bore, an inlet bore, and an outlet bore;

wherein at least one pump body comprises a raised surface on an exterior side surface of the pump body; and wherein the raised surface engages with an adjacent end plate or an adjacent pump body to apply a pre-compressive force at the raised surface on the at least one pump body.

11. The fluid pump assembly of claim 10, wherein each pump body comprises a raised surface on an exterior side surface thereof.

12. The fluid pump assembly of claim 10, wherein the fasteners comprise tie Rods extending through bores aligned through the pump bodies.

13. The fluid pump assembly of claim 10, wherein the adjacent end plate comprises a raised surface, and the raised surface of the at least one pump body engages the raised surface of the adjacent end plate.

14. The fluid pump assembly of claim 10, wherein the raised surface of a pump body engages with the raised surface of an adjacent pump body.

15. The fluid pump assembly of claim 11, wherein the raised surfaces are adjacent an intersection of the piston bore, the inlet bore, and the outlet bore.

16. The fluid pump assembly of claim 10, wherein the pre-compressive force extends the operational life of the assembly by reducing stress adjacent an intersection of the piston bore, the inlet bore, and the outlet bore.

17. The fluid pump assembly of claim 10, further comprising a piston reciprocatably disposed in the piston bore to cycle between relatively high and low fluid pressures in the inlet and outlet bores, wherein the pre-compressive force inhibits initiation of fatigue cracks.

18. A method to inhibit fatigue cracks in a fluid pump assembly comprising a plurality of pump bodies comprising a piston bore, an inlet bore and an outlet bore, comprising:

providing raised surfaces on exterior side surfaces of the plurality of pump bodies;

forming the pump assembly by connecting the plurality of pump bodies side by side between opposing end plates with a plurality of fasteners, wherein the raised surfaces engage with an adjacent end plate or an adjacent pump body; and tightening the fasteners to compress the plurality of pump bodies between the end plates, whereby a pre-compressive force is applied at the raised surfaces on each of the pump bodies.

19. The method of claim 18, further comprising autofrettaging the pump bodies.

20. The method of claim 18, wherein the raised surfaces are adjacent an intersection of the piston bore, the inlet bore, and the outlet bore.

* * * * *